US006255634B1

(12) United States Patent
Bowers

(10) Patent No.: US 6,255,634 B1
(45) Date of Patent: Jul. 3, 2001

(54) TRANSVERSE FLUX HEATING COIL AND METHOD OF USE

(75) Inventor: Thomas J. Bowers, New Berlin, WI (US)

(73) Assignee: Pillar Industries, Brookfield, WI (US)

( * ) Notice: Subject to any disclaimer, the term of this patent is extended or adjusted under 35 U.S.C. 154(b) by 0 days.

(21) Appl. No.: 09/570,827

(22) Filed: May 15, 2000

(51) Int. Cl.[7] ..... H05B 6/10; H05B 6/44

(52) U.S. Cl. ..... 219/636; 219/645; 219/670; 219/672; 219/677; 148/568; 266/129

(58) Field of Search ..... 219/636, 645, 219/646, 670, 672, 673, 677, 635; 266/129; 148/568

(56) References Cited

U.S. PATENT DOCUMENTS

| | | | | |
|---|---|---|---|---|
| 2,935,589 | * | 5/1960 | Baer et al. | 219/635 |
| 3,251,976 | * | 5/1966 | McBrien | 219/673 |
| 3,631,524 | | 12/1971 | Denner | 219/9.5 |
| 3,665,138 | | 5/1972 | Edge et al. | 219/8.5 |
| 3,689,727 | | 9/1972 | Morris | 219/10.79 |
| 3,699,302 | | 10/1972 | Griffith | 219/10.57 |
| 3,842,234 | * | 10/1974 | Seyfried | 219/673 |
| 4,054,770 | | 10/1977 | Jackson et al. | 219/10.61 |
| 4,258,241 | | 3/1981 | Soworowski | 219/10.71 |
| 4,300,031 | | 11/1981 | Reboux et al. | 219/10.41 |
| 4,554,966 | | 11/1985 | Vasiliev et al. | 165/104.21 |
| 4,585,916 | | 4/1986 | Rich | 219/10.61 |
| 4,751,360 | | 6/1988 | Ross | 219/10.61 |
| 4,788,396 | * | 11/1988 | Maugein et al. | 219/636 |
| 4,853,510 | | 8/1989 | Mohr et al. | 219/10.79 |
| 4,972,042 | | 11/1990 | Seabourne et al. | 174/23 |
| 5,214,258 | | 5/1993 | Akers | 219/10.77 |
| 5,317,121 | | 5/1994 | Katayama et al. | 219/672 |
| 5,345,065 | | 9/1994 | Reinke et al. | 219/672 |
| 5,378,879 | | 1/1995 | Monovoukas | 219/634 |
| 5,403,994 | | 4/1995 | Havas et al. | 219/645 |
| 5,495,094 | | 2/1996 | Rowan et al. | 219/645 |
| 5,630,958 | | 5/1997 | Stewart, Jr. et al. | 219/670 |
| 5,837,976 | | 11/1998 | Loveless et al. | 219/645 |

* cited by examiner

*Primary Examiner*—Philip H. Leung
(74) *Attorney, Agent, or Firm*—Cook & Franke S.C.; Timothy J. Ziolkowski

(57) ABSTRACT

A transverse flux heating coil is disclosed to inductively heat a continuous run of wire. In general, the transverse flux heating coil includes a single loop conductive element having a pair of termination ends extending therefrom and connectable to a power supply. The single loop conductive element is constructed to distribute the majority of the current across a width of the single loop conductive element and forms an internal heating area in which a continuous run of wire is fed therethrough. The flux generated by the current is generally transverse to a direction of travel of the wire through the heating coil. The transverse flux heating coil includes a first conductor having a width facing an internal heating area that is substantially greater than a thickness and is constructed of planar copper bar stock. A second conductor, constructed substantially identical to the first conductor, is arranged parallel with the first conductor to form a pair of elongated flux generating sides of the internal heating area. A third conductor is provided at one end of the transverse flux heating coil to conduct current from one of the first and second conductors to the other. In a preferred embodiment, the third conductor also functions as a cooling tube that is brazed to the first and second conductors. The cooling tube serves to conduct current and transfer coolant and is arranged to allow a straight through path for the continuous run of wire through the transverse flux heating coil.

28 Claims, 5 Drawing Sheets

TRANSVERSE FLUX HEATING COIL AND METHOD OF USE

BACKGROUND OF THE INVENTION

The present invention relates generally to inductive heating, and more particularly, to a transverse flux heating coil having a single loop conductive heating element for heating a continuous run of wire therethrough.

The concept of transverse flux induction heating is well known. Typically, such heaters are used to heat strips of thin metal and have two inductor elements, each containing induction coils are arranged in a spaced, parallel relation. The metal strip to be heated is positioned between the two elements and on energizing the coils, magnetic flux is generated from current passing through the two inductor elements and passes through the strip perpendicular to its flat surfaces. This causes induced currents to circulate in the plane of the metal strip material to be heated and thereby causes the temperature in the metal strip to rise. Uniform heating is achieved when the strip is moved at a given speed between the two elements. Transverse flux induction heating operates at relatively high electrical frequencies which are chosen based on the thickness and properties of the metal strip to provide more efficient heating. Transverse flux-type induction coils are commonly used to heat such thin metal strips. Typically, in this type of an arrangement, a plurality of coils are placed adjacent one or both sides of the strip to be heated, and the strip is heated as it is conveyed past the coils. However, these types of induction heaters use an inordinate number of components, are difficult to impedance match with the power supply, and are therefore generally more costly to manufacture.

Where the work piece is a continuous run of wire, the prior art induction heaters use a plurality of coils wrapped around a heating area in which the wire is run through. To create a heating area of sufficient length to heat a wire run adequately at high speeds, the coil is wound about the heating area a number of times until a sufficient length is achieved. The current flowing through these solenoid-type coils causes flux generation in all directions around each turn of the coil. That is, as current travels through the turns of the inductor, flux is generated along the current path in a direction according to the well known right-hand rule. Using multiple turns of a coil thereby causes flux generation outwardly about the entire circumference of each turn of the coil, which results in a majority of the flux generated being other than transverse to the work piece, which in turn greatly reduces the efficiency of such solenoid coils.

It would therefore be advantageous and desirable to create a more efficient induction heating coil in which an increased amount of flux is directed into the heating area, and it would be additionally advantageous to provide therewith a means for simultaneously cooling the conductors of the heating coil.

SUMMARY OF THE INVENTION

The present invention provides an apparatus for inductively heating a continuous run of wire and a method of using the apparatus that overcomes the aforementioned problems.

In accordance with one aspect of the invention, a transverse flux heating coil is disclosed that includes a single loop conductive element having a pair of termination ends extending from the single loop and connectable to a power supply to supply current to the conductive element. The single loop conductive element is constructed to distribute a majority of the current from the power supply across a width of the conductive element that defines the side walls of an internal heating area, wherein the continuous run of wire is fed therethrough at relatively high speeds. The current is relatively evenly distributed across the width of the conductive element and creates a flux that is transverse to the direction of travel of the continuous run of wire to evenly heat the wire as it travels through the internal heating area.

In accordance with another aspect of the invention, a transverse flux heating coil is disclosed having first and second conductors that are comprised of substantially planar bar stock, which in a preferred embodiment, is a relatively thin piece of solid copper material, but is thick enough to absorb and transfer heat without warping. The first and second conductors therefore have a width that is substantially greater than a thickness and are arranged parallel to one another to form the sides of an internal heating area. A third conductor is provided to connect the first and second conductors to form a continuous conductive path. However, the third conductor is arranged at one end of the transverse flux heating coil to provide travel of the work piece parallel with the first and second conductors through the transverse flux heating coil.

In a preferred embodiment, the third conductor also serves as a coolant path. In this manner, a coolant tube is attached to the first and second conductors to transfer heat from the transverse flux heating coil through a coolant medium while simultaneously conducting current from one of the first and second conductors to the other. Alternatively, the first, second, and third conductors could include a contiguous section of planar stock material provided with an opening to allow travel of the work piece therethrough, with an alternative cooling means.

In accordance with yet another aspect of the invention, an inductive heater for efficiently heating a continuous run of wire includes a single-turn transverse flux heating coil having a pair of planar conductors substantially parallel with one another and a conductive cooling tube attached to each of the pair of planar conductors to transfer heat from the single-turn transverse flux heating coil and also simultaneously conduct current from one of the conductors to the other. A power supply is provided to supply current to the single-turn transverse flux heating coil and an induction heating control is connected to the power supply to inductively heat the continuous run of wire. When in operation, current from the power supply travels through the single-turn transverse flux heating coil and causes flux generation that is transverse to a direction of travel of a continuous run of wire through the inductive heater.

The present invention has been simulated with finite element magnetic field software and found to provide efficiency greater than 50%, and upwards of 60%. This level of efficiency is achieved by using a solid planar surface as the conductive medium in the heating area to evenly distribute current across side walls of the heating area. By keeping the current evenly distributed across a relatively thin solid, planar conductor, the flux generated can be more focused into the heating area and heat the traveling work piece faster and more efficiently than prior art systems and methods.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENT

Figure 1:
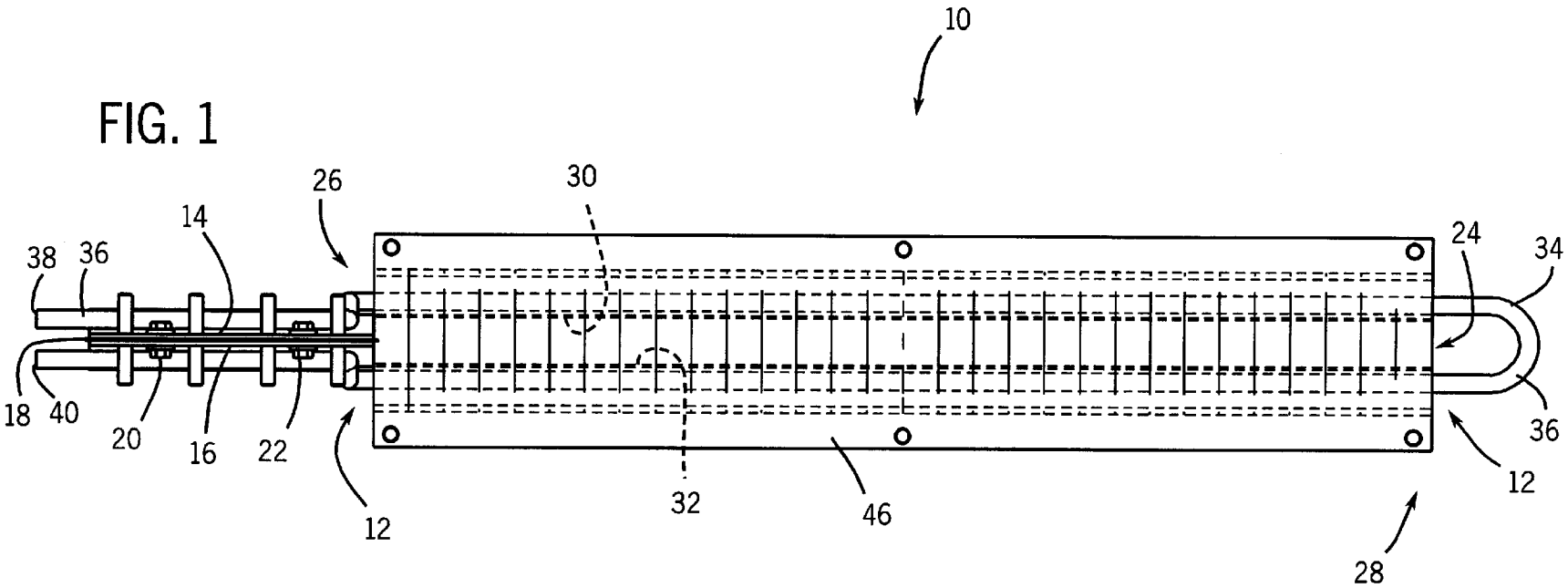
FIG. 1 is a top view of a transverse flux heating coil in accordance with the present invention.

Referring to FIG. 1, a top view of a transverse flux heating coil 10, in accordance with the present invention, is shown in which a single loop conductive element 12 is disposed within the transverse flux heating coil 10. The single loop conductive element 12 has a pair of termination ends 14, 16 separated by an insulator 18 and clamped together with a pair of bolts 20, 22. The termination ends 14, 16 are connectable to a power supply to supply current to the single loop conductive element 12 which is constructed to distribute a majority of the current across a wide distribution path of the single loop conductive element 12 in an internal heating area 24. The transverse flux heating coil 10 is designed to heat a continuous run of a work piece, such as wire, through the internal heating area at a rapid speed. The flux created by the longitudinal runs of the single loop conductive element 12 is transverse to a direction of travel of the work piece and evenly heats the work piece as it travels through the internal heating area 24 from a first end 26 through the transverse flux heating coil 10 and out a second end 28.

In a preferred embodiment, the single loop conductive element 12 includes a first conductor 30 connected to a first termination end 14 and extends the length of the transverse flux coil 10. A second conductor 32 is connected to a second termination end 16 and also extends the length of the transverse flux coil 10, parallel to the first conductor 30. The first and second conductors 30, 32 are connected by a third conductor 34 to form a contiguous current path between the pair of termination ends 14, 16. Preferably, at least the first and second conductors 30, 32 are substantially flat elongated conductors, as will be described further with reference to FIGS. 4 and 5. Transverse flux coil 10 also includes a cooling tube 36 that runs the length of each conductor and has an inlet 38 and an outlet 40 to transmit coolant through the cooling tube 36 to remove heat from the transverse flux coil 10. In a preferred embodiment, the coolant tube 36 also conducts current such that at the second end 28 of the transverse flux coil 10, the coolant tube 36 is also the third conductor 34, as will be further described hereinafter.

Figures 2, 4:
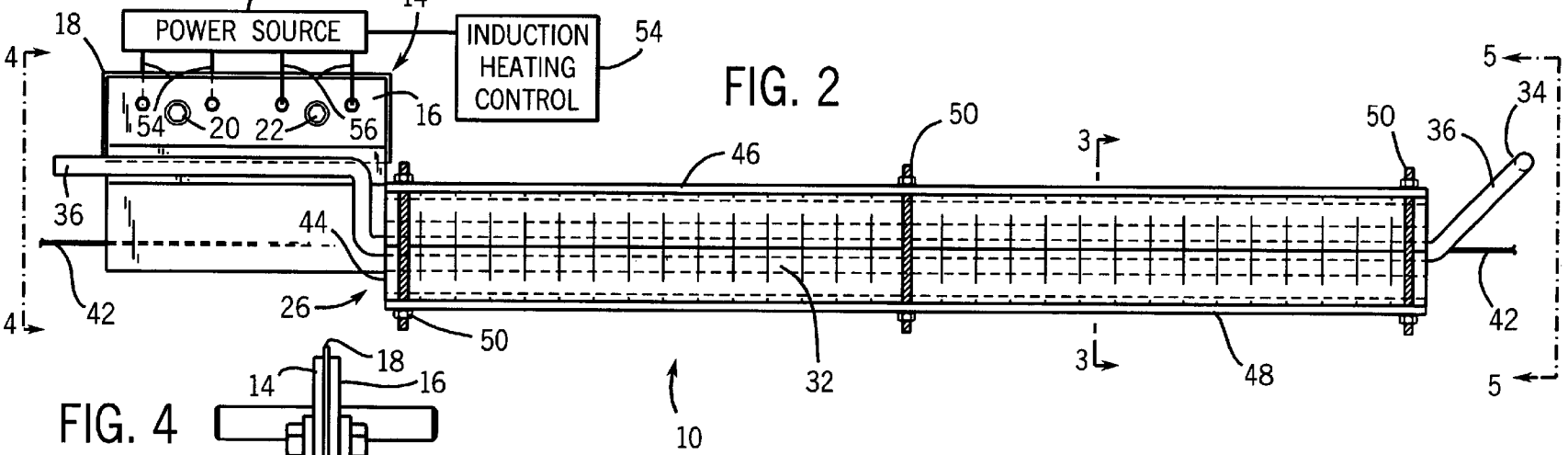
FIG. 2 is a side elevational view of the transverse flux coil shown in FIG. 1.
FIG. 4 is an elevational end view taken along line 4—4 of FIG. 2.

Referring now to FIG. 2, a side elevational view of the transverse flux heating coil of FIG. 1 is shown having a continuous run of a work piece 42, such as wire, being fed into the first end 26 of the transverse flux coil 10, and out the second end 28, or alternatively, vice versa. In the preferred embodiment, as indicated at the second end 28, the third conductor 34 is also the cooling tube 36, and is positioned upwardly to allow travel of the work piece 42 through the transverse flux heating coil 10 in a straight path. The heating coil 10 includes a ferrite core 44 that is sandwiched between a pair of clamping plates 46, 48 that clamps the ferrite core 44 by way of a series of clamping bolt and nut combinations 50. The transverse flux heating coil 10 includes a power source 52 connected to the termination ends 14, 16 to provide AC current through the transverse flux heating coil 10 by way of conductors 30, 32, respectively. The transverse flux heating coil 10 also includes an induction heating control 54 connected to the power source 52 to control the power source in a manner that is well known in the art of induction heating.

Figure 3:
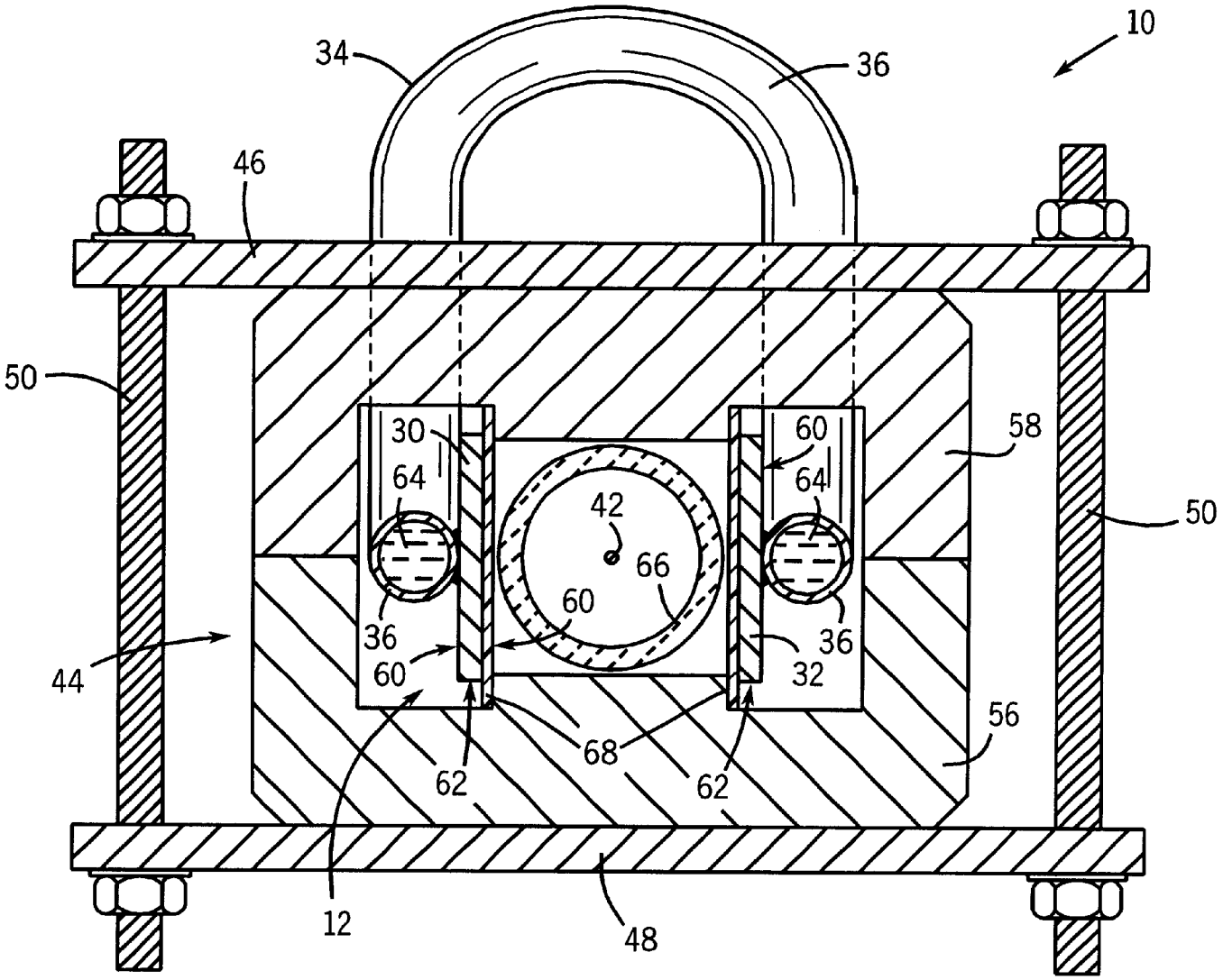
FIG. 3 is a cross-sectional view taken along line 3—3 of FIG. 2.

FIG. 3 shows a cross-sectional view of the transverse flux heating coil 10 taken along line 3—3 of FIG. 2. The ferrite core 44 is formed by a lower ferrite core section 56 and an upper ferrite core section 58 and acts as a flux insulator core enclosing the single loop conductive element 12 to retain and redirect a majority of the flux inwardly to the continuous run of wire 42 as is evident from FIG. 3. The first and second conductors 30, 32 are comprised of a planar bar stock having a width 60 substantially greater than a thickness 62. The third conductor 34 connects the first and second conductors 30, 32, electrically such that during operation, current flows substantially across, and relatively evenly, along the width 60 of the planar bar stock conductors 30, 32, and through the third conductor 34 where the third conductor 34 acts as a jumper between the first and second conductors 30, 32. While the third conductor 34 and the coolant tube 36 are the same structure, they perform different tasks at different locations of the transverse flux coil 10. For example, where the coolant tube 36 is attached to the first and second conductors 30, 32, the coolant tube 36 does not carry much current, but primarily acts to transfer coolant 64 to cool the transverse flux coil 10. In a preferred embodiment, the coolant tubes 36 and the planar bar stock first and second conductors 30, 32 are comprised of copper material and are attached to one another by brazing. Because the overall area of the planar bar stock conductors 30, 32 is much greater than the area of conduction of the coolant tube 36, the first and second conductors 30, 32 conduct the majority of current.

The transverse flux heating coil 10 includes a first insulator 66 situated between the first and second conductors 30, 32, and the work piece 42 to prevent the work piece from contacting the first and second conductors 30, 32, and is preferably ceramic to withstand periodic contact from the continuous run of wire 42. A second insulator 68 can also be provided between the ferrite core 44 and the first and second conductors 30, 32 to isolate the conductors from the ferrite core but need not be ceramic.

FIG. 4 shows an end view of the first end 26 of the transverse flux heating coil 10 taken along line 4—4 of FIG. 2. As indicated, the termination ends 14, 16 are each offset to allow the introduction of the work piece 42 into the transverse flux heating coil 10 and through the protective ceramic insulator 66 within the internal heating area 24. It is noted that the first insulator 66 and the second insulators 68 are electrical insulators, and not intended to insulate thermally. The inlet 38 and the outlet 40 of the coolant tube 36 are brought upward on the transverse flux heating coil 10 to provide sufficient clearance for the continuous run of the work piece 42 through the heating coil 10.

Figure 5:
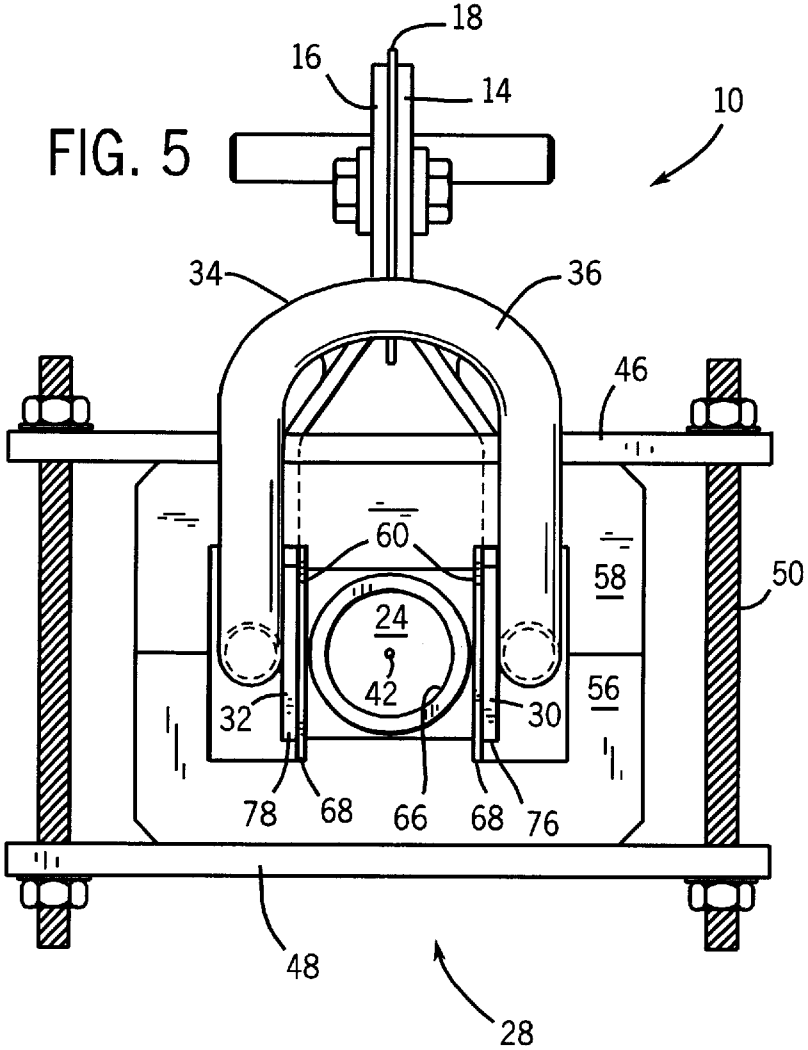
FIG. 5 is an elevational end view taken along line 5—5 of FIG. 2.

FIG. 5 shows an end view of the second end 28 of the transverse flux heating coil of the present invention taken along line 5—5 of FIG. 2. As previously described, the 10 cooling tube 36 extends along a length of the first and second conductors 30, 32 and is in heat transfer communication with the first and second conductors to cool the transverse flux coil 10 via a coolant carried through the coolant tube 36. The coolant tube 36 is constructed to arc upwardly and provide a path for the removal of the work piece wire 42. FIG. 5 also shows the coolant tube 36 attached to the first and second conductors 30, 32 to transfer heat therefrom. In a preferred embodiment, in which the coolant tube 36 and the conductors 30, 32 are all constructed of copper material, the coolant tube 36 is brazed to the conductors, 30, 32 on both sides of the coolant tube 36 along the length of the conductors to create additional contact surface for sufficient heat transfer.

Figure 6:
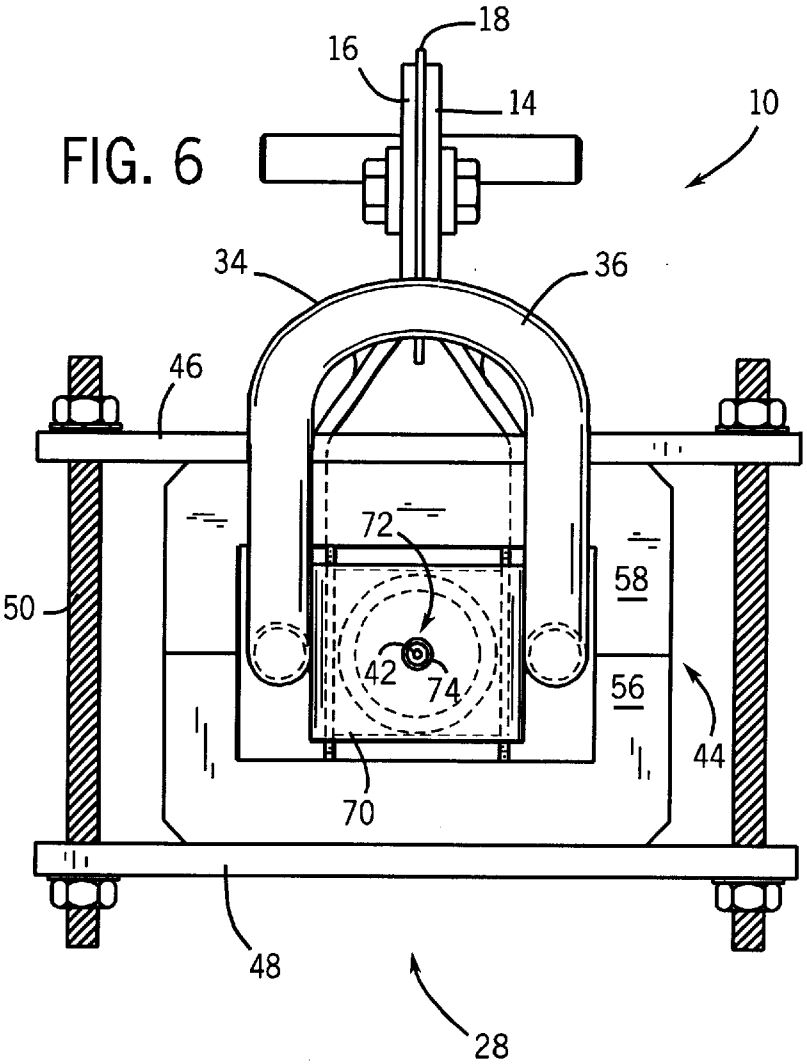
FIG. 6 is an elevational end view, similar to FIG. 5, of an alternate embodiment of the present invention.

FIG. 6 is a similar view as FIG. 5, but shows the use of a contiguous piece of planar bar stock 70 to function as the first, second, and third conductors wherein the planar bar stock is bent to have a U-shape at the exit end 28 of the transverse flux heating coil 10. The contiguous conductor 70 has an opening 72 having an insulator 74 therein to allow passage of the work piece 42 through the contiguous conductor 70 without contacting the contiguous conductor 70. In this embodiment, the coolant tube 36 need not be constructive copper material and need not conduct electricity. However, in terms of heat transfer capabilities and ease of construction, with the copper tube being of the same material as the conductor, the coolant tube can easily be brazed to the conductor, as previously described.

Figure 7:
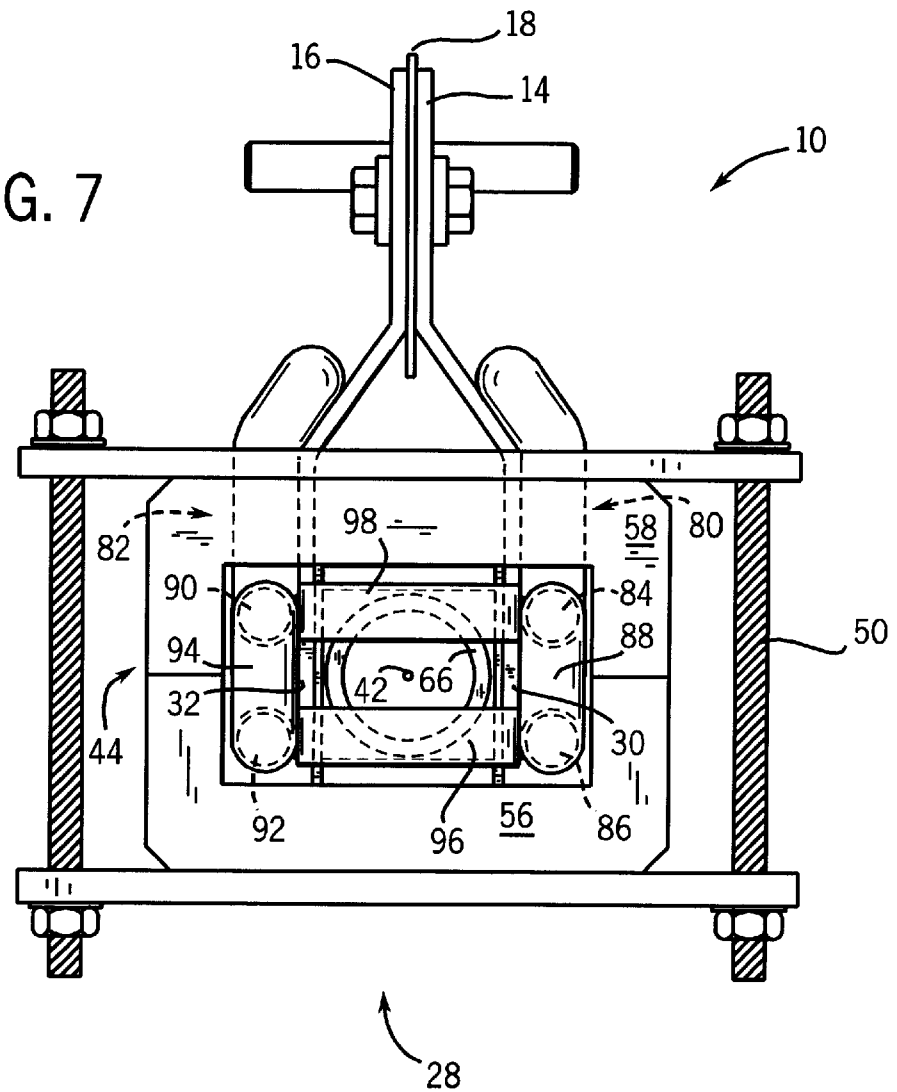
FIG. 7 is an elevational end view, similar to FIG. 5, of an alternate embodiment of the present invention.

FIG. 7 shows yet another embodiment of the present invention in which each of the first and second conductors 30, 32 are provided with their own separate cooling tubes 80, 82, respectively. That is, secured to the first conductor 30 is a supply cooling tube 84 and a return cooling tube 86 fluidly connected with a bridge 88. Similarly, the second conductor 32 has a supply cooling tube 90, a return cooling tube 92, each connected by a bridge 94 to transfer heat from the conductors 32. Accordingly, some form of conductive path must be provided between the first and second conductors. In the embodiment shown in FIG. 7, a lower conductor jumper 96 and an upper conductor jumper 98 are electrically connected to the first and second conductors 30, 32 to form a contiguous current path. The size and shape of conductors 96 and 98 will vary according to the need to allow sufficient room to allow travel of the work piece 42 therebetween, yet large enough to distribute current across the width of the conductors 30, 32. In this regard, the conductors 96, 98 are preferably insulated, and may be shaped with an arc-shape opening to coincide with the insulator 66.

Referring to each embodiment shown in FIGS. 5–7, preferably, the clamping plates 46, 48 are constructed of copper to transfer heat from the ferrite core 44. In a commercial embodiment, a heat exchanger (not shown) is provided to transfer heat from the ferrite core 44 via the copper plates 46, 48.

Referring to opposing end views FIG. 4 and FIG. 5, the first and second conductors 30, 32 are preferably comprised of a planar bar stock conductive material having a width 60 substantially greater than a thickness 62, wherein the width 60 is defined as the side of the conductor facing the work piece 42 in the internal heating area 24. The thickness 62 is defined as the side edge of the conductor that is adjacent the width side 60 and perpendicular to the width side. The first and second conductors 30, 32 also have first termination ends 14, 16 connectable to the power source 52, FIG. 2. The first and second conductors have a second termination end 76, 78, respectively, connected to the third conductor 34. Since the third conductor 34 is also the coolant tube 36, and serves two purposes, it is contemplated that the present invention includes a number of alternate embodiments, some of which were described with reference to FIGS. 6 and 7. However, others are contemplated and should be evident to those skilled in the art. For example, the multiple functions of the combination of the third conductor 34 and cooling tube 36 can be separated and equivalently performed in numerous ways. In accordance with the present invention, a third conductor is provided to serve as a current path between the first and second conductors 30, 32. Therefore, where the current is carried through the coolant tube 36 from one conductor to the other, as shown in FIG. 5, or the first, second, and third conductors are each a single contiguous conductor, as shown in FIG. 6, or a separate jumper, or a plurality of jumpers are provided to conduct current from the first to the second conductor as shown in FIG. 7, each is considered equivalent and embodied in the scope of the appending claims. The second purpose of the third conductor 34 and coolant tube 36 combination, is to provide a return path for coolant. Equivalently, the coolant tube could be constructed of a non-conductive material where another path is provided for current flow, or separate cooling tubes can be provided on each side of the transverse flux heating coil, as shown in FIG. 7, without having to cross over the second end 28 of the transverse flux heating coil 10, as shown in FIG. 5 and 6. As one skilled in the art will readily recognize, there are a number of different configurations that can be provided to accommodate the same function and purpose as set forth above. It is contemplated that each of these various configurations are within the scope of the appending claims regardless if explicitly shown in the drawings.

Accordingly, an inductive heater 10 is disclosed for efficiently heating a continuous run of wire 42 that includes a single-turn transverse flux heating coil 12 having a pair of planar conductors 30, 32 that are substantially parallel with one another. It is understood that the term "pair" refers to the fact that the conductors 30, 32 run parallel with one another, and includes a configuration in which the conductors are actually a single contiguous conductor, or any series of such conductors. In a preferred embodiment, the inductive heater 10 includes a conductive cooling tube 36 attached to each of the pair of planar conductors 30, 32 to transfer heat from the heating coil 12 and conduct current from one of the conductors to the other. A power supply 52 is connected to the single-turn transverse flux heating coil 12 to supply current therethrough. An induction heating control 54 is connected to control the power supply, in a well known manner.

When in operation, current from the power supply 52 traveling through the single-turn transverse flux heating coil 12 causes flux generation transverse to a direction of travel of the continuous run of wire 42 through the inductive heater. Also in a preferred embodiment, a ceramic insulator 66 is provided to withstand the rigors of feeding the wire through the inductive heater at high speed. The ceramic insulator is within an internal heating area 24.

The preferred embodiment was simulated on a finite element magnetic field simulator using an exemplary 0.2" steel wire and was able to effectively heat the wire to 1650° F. at a speed of 760 lbs/hr. Further, this construction resulted in an efficiency of greater than 50%, and as much as 60%.

The present invention also includes a method of heating a wire by induction that includes conducting and distributing current through and across a first planar conductive surface, then conducting current through a cooling tube from the first planar conductive surface to a second planar conductive surface, and then conducting and distributing the current across the second planar conductive surface. In this manner, current is efficiently distributed evenly across an entire side of the internal heating area of the induction heater. The method also includes insulating flux about a circumference of the first and second planar conductive surfaces and insulating an interior of the first and second planar conductive surfaces to define the internal heating area. The method next includes passing wire through the interior of the first and second conductive surfaces to heat the wire through a desired temperature as it is continuously run through the inductive heater.

The present invention has been described in terms of the preferred embodiment, and it is recognized that equivalents, alternatives, and modifications, aside from those expressly stated, are possible and within the scope of the appending claims.

What is claimed is:

1. A transverse flux heating coil comprising:

a first conductor comprised of a substantially planar bar stock having a width substantially greater than a thickness and having first and second termination ends;

a second conductor comprised of a substantially planar bar stock having a width substantially greater than a thickness and having first and second termination ends;

a third conductor connecting the second termination end of the first conductor to the second termination end of the second conductor to form a conductive path from the first termination end of the first conductor to the first termination end of the second conductor; and wherein the first conductor and second conductor are substantially parallel and the third conductor is arranged to provide for travel of a work piece straight through the transverse flux heating coil parallel with the first and second conductors.

2. The transverse flux heating coil of claim 1 further comprising an insulator situated between the first and second conductors and the work piece to prevent the work piece from contacting the first and second conductors.

3. The transverse flux heating coil of claim 2 wherein the work piece is a continuous run of wire and the insulator is ceramic to withstand periodic contact from the continuous run of wire.

4. The transverse flux heating coil of claim 1 wherein the third conductor is a cooling tube and is positioned to provide travel of the work piece through the transverse flux heating coil.

5. The transverse flux heating coil of claim 4 wherein the cooling tube extends along a length of the first and second conductors and is in heat transfer communication with the first and second conductors and carries a coolant therethrough.

6. The transverse flux heating coil of claim 5 wherein the cooling tube and each conductor are comprised of copper and the cooling tube is brazed to the first and second conductors.

7. The transverse flux heating coil of claim 1 wherein the first, second and third conductors are a contiguous piece of planar bar stock having a U-shape with a second opening opposite a first opening therein to allow travel of the work piece therethrough.

8. The transverse flux heating coil of claim 1 further comprising:

a ferrite core enclosing the first and second conductors; and a second insulator situated between the ferrite core and the first and second conductors.

9. The transverse flux heating coil of claim 1 further comprising:

a power source connected to the first termination ends of the first and second conductors to provide AC current through the transverse flux heating coil; and an induction heating control connected to control the power source.

10. The transverse flux heating coil of claim 1 wherein the third conductor is comprised of a non-planar conductor and wherein the first and second conductors have a surface area facing the work piece that directs substantially more flux toward the work piece than the third conductor.

11. A transverse flux heating coil comprising:

a single loop conductive element having a pair of termination ends extending from the single loop conductive coil and connectable to a power supply to supply current to the single loop conductive element and wherein the single loop conductive element is constructed to distribute a majority of the current across a width of the single loop conductive element, wherein the width of the single loop conductive element forms an internal heating area in which a continuous run of a work piece is fed therethrough, and wherein the majority of current distributed across the width of the single loop conductive element creates a flux that is transverse to a direction of travel of the continuous run of the work piece, and wherein the transverse flux evenly heats the continuous run of the work piece as it travels through the internal heating area;

an internal insulator situated in the internal heating area of the single loop conductive coil to insulate the work piece from the single loop conductive element; and a ferrite core surrounding a majority of the single loop conductive element.

12. The transverse flux heating coil of claim 11 wherein the single loop conductive element is comprised of a first, second and third conductor, each connected to form a contiguous current path between the pair of termination ends, and wherein at least the first and second conductors are substantially flat elongated conductors.

13. The transverse flux heating coil of claim 12 wherein the substantially flat elongated conductors are comprised of planar copper bar stock.

14. The transverse flux heating coil of claim 12 wherein the third conductor is a conductive jumper to conductively connect the first and second conductors.

15. The transverse flux heating coil of claim 14 further comprising a cooling tube attached to the single loop conductive element to remove heat from the transverse flux heating coil.

16. The transverse flux heating coil of claim 12 wherein the third conductor is a cooling tube.

17. The transverse flux heating coil of claim 11 wherein the internal insulator is comprised of ceramic to withstand contact from the continuous run of the work piece through the internal heating area.

18. The transverse flux heating coil of claim 11 wherein the ferrite core is comprised of upper and lower sections and is situated around the single loop conductive element to retain flux within the transverse flux heating coil and redirect flux into the internal heating area.

19. The transverse flux heating coil of claim 11 further comprising:

a power source connected to the pair of termination ends of the single loop conductive element to provide AC current through the transverse flux heating coil; and an induction heating control connected to control the power source.

20. The transverse flux heating coil of claim 11 further comprising a heat exchanger in heat transfer communication within the single loop conductive element.

21. The transverse flux heating coil of claim 20 wherein the heat exchanger is a cooling tube comprised of copper to carry coolant therethrough and current therealong.

22. An inductive heater for efficiently heating a continuous run of wire comprising:

a single-turn transverse flux heating coil having a pair of planar conductors substantially parallel with one another and a conductive cooling tube attached to each of the pair of planar conductors to transfer heat from the single-turn transverse flux heating coil and conduct current from one of the pair of planar conductors to another of the pair of planar conductors;

a power supply connected to the single-turn transverse flux heating coil to supply current therethrough;

an induction heating control connected to control the power supply; and wherein, when in operation, current from the power supply traveling through the single-turn transverse flux heating coil causes flux generation transverse to a direction of travel of a continuous run of wire through the inductive heater.

23. The inductive heater of claim 22 capable of greater than 50% efficiency.

24. The inductive heater of claim 22 further comprising a ceramic insulator enclosing an internal heating area.

25. The inductive heater of claim 22 further comprising a flux insulator core enclosing the pair of planar conductors to retain a majority of flux inward to the continuous run of wire.

26. A method of heating a work piece by induction comprising the steps of:

(A) conducting and distributing current through and across a first planar conductive surface;

(B) conducting current through a cooling tube from the first planar conductive surface;

(C) conducting and distributing current from the cooling tube through and across a second planar conductive surface;

(D) insulating flux about a circumference of the first and second planar conductive surfaces;

(E) insulating an interior of the first and second planar conductive surfaces; and (F) passing a work piece through the interior of the first and second conductive surfaces.

27. The method of claim 26 wherein steps (A), (B) and (C) are performed in a single-turn heating coil.

28. The method of claim 26 wherein step (F) is further defined as treating an exemplary 0.2" wire at 760 lbs/hr.

* * * * *

UNITED STATES PATENT AND TRADEMARK OFFICE

CERTIFICATE OF CORRECTION

PATENT NO. : 6,255,634 B1
DATED : July 3, 2001
INVENTOR(S) : Bowers, Thomas

It is certified that error appears in the above-identified patent and that said Letters Patent is hereby corrected as shown below:

Column 4,
Line 64, insert "10" after "transverse flux heating coil"
Line 65, delete "10"

Signed and Sealed this

Twenty-ninth Day of January, 2002

*Attest:*

*Attesting Officer*

JAMES E. ROGAN
*Director of the United States Patent and Trademark Office*